US006673507B1

(12) United States Patent
Dickerson et al.

(10) Patent No.: US 6,673,507 B1
(45) Date of Patent: Jan. 6, 2004

(54) RADIOGRAPHIC FILM FOR MAMMOGRAPHY WITH IMPROVED PROCESSABILITY

(75) Inventors: Robert E. Dickerson, Hamlin, NY (US); Anthony Adin, Rochester, NY (US); Richard E. Beal, Ontario, NY (US); Anthony D. Gingello, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/440,950

(22) Filed: May 19, 2003

Related U.S. Application Data

(63) Continuation-in-part of application No. 10/299,237, filed on Nov. 19, 2002.

(51) Int. Cl.[7] ..... G03C 1/035; G03C 1/46; G03C 5/17

(52) U.S. Cl. ..... 430/139; 430/502; 430/509; 430/428; 430/567; 430/966

(58) Field of Search ..... 430/139, 502, 430/509, 966, 567, 428

(56) References Cited

U.S. PATENT DOCUMENTS 4,710,637 A 12/1987 Luckey et al.
4,937,180 A * 6/1990 Marchetti et al. ..... 430/567
5,455,139 A * 10/1995 Wada et al. ..... 430/502
5,738,981 A 4/1998 Dickerson et al.
5,759,754 A 6/1998 Dickerson
5,853,967 A 12/1998 Dickerson
5,998,083 A * 12/1999 Verbeeck et al. ..... 430/567
6,033,840 A 3/2000 Dickerson
6,037,112 A 3/2000 Dickerson

OTHER PUBLICATIONS

USSN 10/299,123—filed Nov. 19, 2002, titled *Radiographic Silver Halide Film For Mammography with Reduced Dye Stain,* by Dickerson et al.
USSN 10/299,765—filed Nov. 19, 2002, titled *Mammography Film And Imaging Assembly For Use With Rhodium Anodes,* by Dickerson et al.
USSN 10/299,941—filed Nov. 19, 2002, titled *Mammography Imaging Method Using High Peak Voltage,* by Dickerson et al.
USSN 10/299,759—filed Nov. 19, 2002, titled *Mammography Imaging Method Using High Peak Voltage and Rhodium Or Tungsten Anodes,* by Dickerson et al.
USSN 10/299,475—filed Nov. 19, 2002, titled *High Bromide Cubic Grain Emulsions*, by Adin et al.

* cited by examiner

*Primary Examiner*—Richard L. Schilling
(74) *Attorney, Agent, or Firm*—J. Lanny Tucker

(57) ABSTRACT

A radiographic silver halide film has improved processability because it includes a silver halide emulsion composed of cubic grains having a critical molar ratio of chloride, iodide, and bromide. In particular, the cubic grains comprise from about 1 to about 20 mol % of chloride and from about 0.25 to about 1.5 mol % of iodide, with the remainder being bromide. The cubic grains also have an ECD of from about 0.65 to about 0.8 μm. This film is particularly useful in mammography for imaging dense soft tissue.

14 Claims, 1 Drawing Sheet

RADIOGRAPHIC FILM FOR MAMMOGRAPHY WITH IMPROVED PROCESSABILITY

RELATED APPLICATION

This is a Continuation-in-part of U.S. Ser. No. 10/299,237 filed Nov. 19, 2002 by Dickerson, Adin, Beal and Gingello.

FIELD OF THE INVENTION

This invention is directed to radiography. In particular, it is directed to a radiographic silver halide film that provides improved medical diagnostic images of soft tissues such as in mammography and exhibits improved processing characteristics.

BACKGROUND OF THE INVENTION

The use of radiation-sensitive silver halide emulsions for medical diagnostic imaging can be traced to Roentgen's discovery of X-radiation by the inadvertent exposure of a silver halide film. Eastman Kodak Company then introduced its first product specifically that was intended to be exposed by X-radiation in 1913.

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5% or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.) and U.S. Pat. No. 4,425,426 (Abbott et al.), U.S. Pat. No. 4,414,310 (Dickerson), U.S. Pat. No. 4,803,150 (Kelly et al.), U.S. Pat. No. 4,900,652 (Kelly et al.), U.S. Pat. No. 5,252,442 (Tsaur et al.), and Research Disclosure, Vol. 184, August 1979, Item 18431.

While the necessity of limiting patient exposure to high levels of X-radiation was quickly appreciated, the question of patient exposure to even low levels of X-radiation emerged gradually. The separate development of soft tissue radiography, which requires much lower levels of X-radiation, can be illustrated by mammography. The first intensifying screen-film combination (imaging assembly) for mammography was introduced to the public in the early 1970's. Mammography film generally contains a single silver halide emulsion layer and is exposed by a single intensifying screen, usually interposed between the film and the source of X-radiation. Mammography utilizes low energy X-radiation, that is radiation that is predominantly of an energy level less than 40 keV.

U.S. Pat. No. 6,033,840 (Dickerson) and U.S. Pat. No. 6,037,112 (Dickerson) describe asymmetric imaging elements and processing methods for imaging soft tissue.

Problem to be Solved

In mammography, as in many forms of soft tissue radiography, pathological features sought to be identified are often quite small and not much different in density than surrounding healthy tissue. Thus, mammography is a very difficult task in medical radiography. In addition, microcalcifications must be seen when they are as small as possible to improve detection and treatment of breast cancers. As a result, mammographic films often include relatively high amounts of silver and gelatin to maximize image sharpness when used with a single intensifying screen. The higher amounts of silver and gel may mean that the films are more difficult to process or require longer processing times.

SUMMARY OF THE INVENTION

This invention provides a solution to the noted problems with a radiographic silver halide film comprising a support having first and second major surfaces and that is capable of transmitting X-radiation, the radiographic silver halide film having disposed on the first major support surface, one or more hydrophilic colloid layers including at least one cubic silver halide grain emulsion layer, and on the second major support surface, one or more hydrophilic colloid layers including at least one silver halide emulsion layer, wherein the cubic silver halide grain emulsion layer comprises cubic silver halide grains comprising from about 1 to about 20 mol % chloride and from about 0.25 to about 1.5 mol % iodide, both based on total silver in the emulsion layer, which cubic silver halide grains have an average ECD of from about 0.65 to about 0.8 $\mu$m.

Further, this invention provides a method of providing a black-and-white image comprising exposing a radiographic silver halide film of this invention and processing it, sequentially, with a black-and-white developing composition and a fixing composition, the processing being carried out within 90 seconds, dry-to-dry.

This invention also provides a radiographic imaging assembly comprising a radiographic silver halide film of this invention that is arranged in association with a fluorescent intensifying screen.

The present invention provides a means for providing radiographic images for mammography with a radiographic film that is readily processed using the conventional processing solutions known in the art. In addition, all other desirable sensitometric properties are maintained or improved (such as photographic speed). If desired, the amount of silver used in the films can be reduced without a significant loss in photographic speed.

These advantages are achieved by including certain cubic silver halide grains that are comprised of specific amounts of chloride, iodide, and bromide. The critical amount of iodide provides desired photographic speed and the critical amount of chloride provides desired image tone and rapid processability.

DETAILED DESCRIPTION OF THE INVENTION

Figure 1:
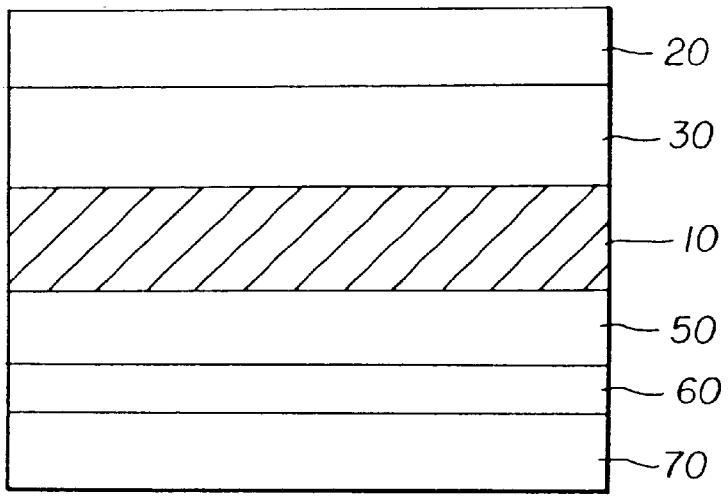
FIG. 1 is a schematic cross-sectional illustration of a radiographic silver halide film of this invention.

The term "contrast" as herein employed indicates the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta \log_{10}E$ ($\log_{10}E_2 - \log_{10}E_1$), $E_1$ and $E_2$ being the exposure levels at the reference points (1) and (2).

"Gamma" is described as the instantaneous rate of change of a D logE sensitometric curve or the instantaneous contrast at any logE value.

Photographic "speed" refers to the exposure necessary to obtain a density of at least 1.0 plus $D_{min}$.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" is employed to indicate dry-to-dry processing of a radiographic film in 45 seconds or less. That is, 45 seconds or less elapse from the time a dry imagewise exposed radiographic film enters a wet processor until it emerges as a dry fully processed film.

In referring to grains and silver halide emulsions containing two or more halides, the halides are named in order of ascending concentrations.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as 100 times the standard deviation (a) of grain ECD divided by the mean grain ECD.

The term "covering power" is used to indicate 100 times the ratio of maximum density to developed silver measured in $mg/dm^2$.

The term "dual-coated" is used to define a radiographic film having silver halide emulsion layers disposed on both the front- and backsides of the support. The radiographic silver halide films of the present invention are "dual-coated."

The term "fluorescent intensifying screen" refers to a screen that absorbs X-radiation and emits light. A "prompt" emitting fluorescent intensifying screen will emit light immediately upon exposure to radiation while "storage" fluorescent screen can "store" the exposing X-radiation for emission at a later time when the screen is irradiated with other radiation (usually visible light).

The terms "front" and "back" refer to layers, films, or intensifying screens nearer to and farther from, respectively, the X-radiation source.

Research Disclosure is published by Kenneth Mason Publications, Ltd., Dudley House, 12 North St., Emsworth, Hampshire P010 7DQ England. The publication is also available from Emsworth Design Inc., 147 West 24th Street, New York, N.Y. 10011.

The radiographic silver halide films of this invention include a flexible support having disposed on both sides thereof, one or more photographic silver halide emulsion layers and optionally one or more non-radiation sensitive hydrophilic layer(s). The silver halide emulsions in the various layers can be the same or different and can comprise mixtures of various silver halide emulsions within the requirements of this invention.

In preferred embodiments, the photographic silver halide film has at least one different silver halide emulsion on each side of the support. It is also preferred that the film has a protective overcoat (described below) over the silver halide emulsions on each side of the support.

The support can take the form of any conventional radiographic film support that is X-radiation and light transmissive. Useful supports for the films of this invention can be chosen from among those described in Research Disclosure, September 1996, Item 38957 XV. Supports and Research Disclosure, Vol. 184, August 1979, Item 18431, XII. Film Supports.

The support is preferably a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to Research Disclosure, Item 38957, Section XV Supports, cited above, attention is directed particularly to paragraph (2) that describes subbing layers, and paragraph (7) that describes preferred polyester film supports.

Polyethylene terephthalate and polyethylene naphthalate are the preferred transparent film support materials.

In the more preferred embodiments, at least one non-light sensitive hydrophilic layer is included with the one or more silver halide emulsion layers on each side of the film support. This layer may be called an interlayer or overcoat, or both.

Preferably, the "frontside" of the support comprises one or more silver halide emulsion layers, one of which contains predominantly cubic grains (that is, more than 50 weight % of all grains). These cubic silver halide grains particularly include predominantly (at least 69 mol %) bromide, and preferably up to 89.75 mol % bromide, based on total silver in the emulsion layer. In addition, these cubic grains must have from about 1 to about 20 mol % chloride (preferably from about 10 to about 20 mol % chloride) and from about 0.25 to about 1.5 mol % iodide (preferably from about 0.5 to about 1 mol % iodide), based on total silver in the emulsion layer. The cubic silver halide grains in each silver halide emulsion unit (or silver halide emulsion layers) can be the same or different.

The amount of chloride in the cubic silver halide grains is critical to provide desired processability and image tone while the amount of iodide is critical to provide desired photographic speed. Too much chloride results in poor absorption of spectral sensitizing dyes to the grains.

The non-cubic silver halide grains in the "frontside" emulsion layers can have any desirable morphology including, but not limited to, octahedral, tetradecahedral, rounded, spherical or other non-tabular morphologies, or be comprised of a mixture of two or more of such morphologies.

It may also be desirable to employ silver halide grains that exhibit a coefficient of variation (COV) of grain ECD of less than 20% and, preferably, less than 10%. In some embodiments, it may be desirable to employ a grain population that is as highly monodisperse as can be conveniently realized.

The average silver halide grain size can vary within each emulsion layer within the film. For example, the cubic grain ECD in the radiographic silver halide film is independently and generally from about 0.65 to about 0.8 $\mu$m (preferably from about 0.7 to about 0.75 $\mu$m).

The backside ("second major support surface") of the support includes one or more silver halide emulsions, preferably at least one of which comprises predominantly tabular silver halide grains. Generally, at least 50% (and preferably at least 80%) of the silver halide grain projected area in this silver halide emulsion layer is provided by tabular grains having an average aspect ratio greater than 5, and more preferably greater than 10. The remainder of the silver halide projected area is provided by silver halide grains having one or more non-tabular morphologies. In addition, the tabular grains are predominantly (at least 90 mol %) bromide based on the total silver in the emulsion layer and includes up to 1 mol % iodide. Preferably, the tabular grains are pure silver bromide.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.). The patents to Abbott et al., Fenton et al., Dickerson, and Dickerson et al. are also cited and incorporated herein to show conventional radiographic film features in addition to gelatino-vehicle, high bromide (≧80 mol % bromide based on total silver) tabular grain emulsions and other features useful in the present invention.

The backside of the radiographic silver halide film also preferably includes an antihalation layer disposed over the silver halide emulsion layer(s). This layer comprises one or more antihalation dyes or pigments dispersed on a suitable hydrophilic binder (described below). In general, such antihalation dyes or pigments are chosen to absorb whatever radiation the film is likely to be exposed to from a fluorescent intensifying screen. For example, pigments and dyes that can be used as antihalation pigments or dyes include various water-soluble, liquid crystalline, or particulate magenta or yellow filter dyes or pigments including those described for example in U.S. Pat. No. 4,803,150 (Dickerson et al.), U.S. Pat. No. 5,213,956 (Diehl et al.), U.S. Pat. No. 5,399,690 (Diehl et al.), U.S. Pat. No. 5,922,523 (Helber et al.), U.S. Pat. No. 6,214,499 (Helber et al.), and Japanese Kokai 2-123349, all of which are incorporated herein by reference for pigments and dyes useful in the practice of this invention. One useful class of particulate antihalation dyes includes nonionic polymethine dyes such as merocyanine, oxonol, hemioxonol, styryl, and arylidene dyes as described in U.S. Pat. No. 4,803,150 (noted above) that is incorporated herein for the definitions of those dyes. The magenta merocyanine and oxonol dyes are preferred and the oxonol dyes are most preferred.

The amounts of such dyes or pigments in the antihalation layer are generally from about 1 to about 3 mg/dm$^2$. A particularly useful antihalation dye is the magenta filter dye M−1 identified as follows:

M-1.

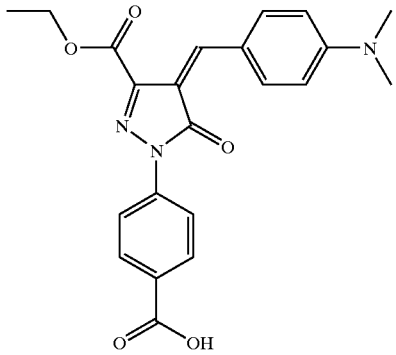

A variety of silver halide dopants can be used, individually and in combination, in one or more of the silver halide emulsion layers to improve contrast as well as other common sensitometric properties. A summary of conventional dopants is provided by Research Disclosure, Item 38957, cited above, Section I. Emulsion grains and their preparation, sub-section D. Grain modifying conditions and adjustments, paragraphs (3), (4), and (5).

A general summary of silver halide emulsions and their preparation is provided by Research Disclosure, Item 38957, cited above, Section I. Emulsion grains and their preparation. After precipitation and before chemical sensitization the emulsions can be washed by any convenient conventional technique using techniques disclosed by Research Disclosure, Item 38957, cited above, Section III. Emulsion washing.

Any of the emulsions can be chemically sensitized by any convenient conventional technique as illustrated by Research Disclosure, Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine, or rhodanine. A combination of gold and sulfur sensitization is most preferred.

In addition, if desired, the silver halide emulsions can include one or more suitable spectral sensitizing dyes, for example cyanine and merocyanine spectral sensitizing dyes, including the benzimidazolocarbocyanine dyes described in U.S. Pat. No. 5,210,014 (Anderson et al.), incorporated herein by reference. The useful amounts of such dyes are well known in the art but are generally within the range of from about 200 to about 1000 mg/mole of silver in the emulsion layer.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by Research Disclosure, Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or=S moiety. Such compounds include, but are not limited to, 5-mercapotetrazoles, dithioxotriazoles, mercapto-substituted tetraazaindenes, and others described in U.S. Pat. No. 5,800,976 (Dickerson et al.) that is incorporated herein by reference for the teaching of the sulfur-containing covering power enhancing compounds.

The silver halide emulsion layers and other hydrophilic layers on both sides of the support of the radiographic films of this invention generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in Research Disclosure, Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al.), incorporated herein by reference.

The silver halide emulsion layers (and other hydrophilic layers) in the radiographic films are generally hardened to various degrees using one or more conventional hardeners.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydihydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (for example, mucochloric and mucobromic acids), onium-substituted acroleins, vinyl sulfones containing other hardening functional groups, polymeric hardeners such as dialdehyde starches, and poly (acrolein-co-methacrylic acid).

The levels of silver and polymer vehicle in the radiographic silver halide film of the present invention are not critical. In general, the total amount of silver on each side of the film is at least 10 and no more than 55 mg/dm$^2$ in one or more emulsion layers. In addition, the total coverage of polymer vehicle on each side of the film is generally at least 35 and no more than 45 mg/dm$^2$ in all of the hydrophilic layers on that side. The amounts of silver and polymer vehicle on the two sides of the support in the radiographic silver halide film can be the same or different. These amounts refer to dry weights.

The radiographic silver halide films of this invention generally include a surface protective overcoat disposed on each side of the support that typically provides physical protection of the emulsion layers. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by Research Disclosure, Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. The overcoat on at least one side of the support can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers. Protective overcoats are provided to perform two basic functions. They provide a layer between the emulsion layers and the surface of the film for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

The various coated layers of radiographic silver halide films of this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

Preferred embodiments of this invention include radiographic silver halide films comprising a support having first and second major surfaces and that is capable of transmitting X-radiation, the radiographic silver halide films having disposed on the first major support surface, one or more hydrophilic colloid layers including at least one cubic silver halide grain emulsion layer, and on the second major support surface, one or more hydrophilic colloid layers including at least one silver halide emulsion layer comprising predominantly tabular silver halide grains, and an anti-halation layer, wherein the silver halide cubic grain emulsion layer comprises predominantly cubic silver halide grains comprising from about 10 to about 20 mol % chloride and from about 0.5 to about 1.5 mol % iodide, both based on total silver in the emulsion layer, which cubic grains have an average ECD of from about 0.7 to about 0.75 μm, and a protective overcoat disposed over the silver halide emulsion layers on both sides of the support.

The radiographic imaging assemblies of the present invention are composed of one radiographic silver halide film of this invention and a fluorescent intensifying screen. Usually, a single fluorescent intensifying screen is used on the "frontside" for mammography. Fluorescent intensifying screens are typically designed to absorb X-rays and to emit electromagnetic radiation having a wavelength greater than 300 nm. These screens can take any convenient form providing they meet all of the usual requirements for use in radiographic imaging. Examples of conventional, useful fluorescent intensifying screens are provided by Research Disclosure, Item 18431, cited above, Section IX. X-Ray Screens/Phosphors, and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains phosphor particles and a binder, optimally additionally containing a light scattering material, such as titania.

Any conventional or useful phosphor can be used, singly or in mixtures, in the intensifying screens used in the practice of this invention. For example, useful phosphors are described in numerous references relating to fluorescent intensifying screens, including but not limited to, Research Disclosure, Vol. 184, August 1979, Item 18431, Section IX, X-ray Screens/Phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP-A-0 491,116 (Benzo et al.), the disclosures of all of which are incorporated herein by reference with respect to the phosphors.

An embodiment of the radiographic film of the present invention is illustrated in FIG. 1. On the frontside of support 10 are disposed overcoat 20, and emulsion layer 30. On the backside of support 10 are disposed emulsion layer 50, antihalation layer 60, and overcoat 70.

Figure 2:
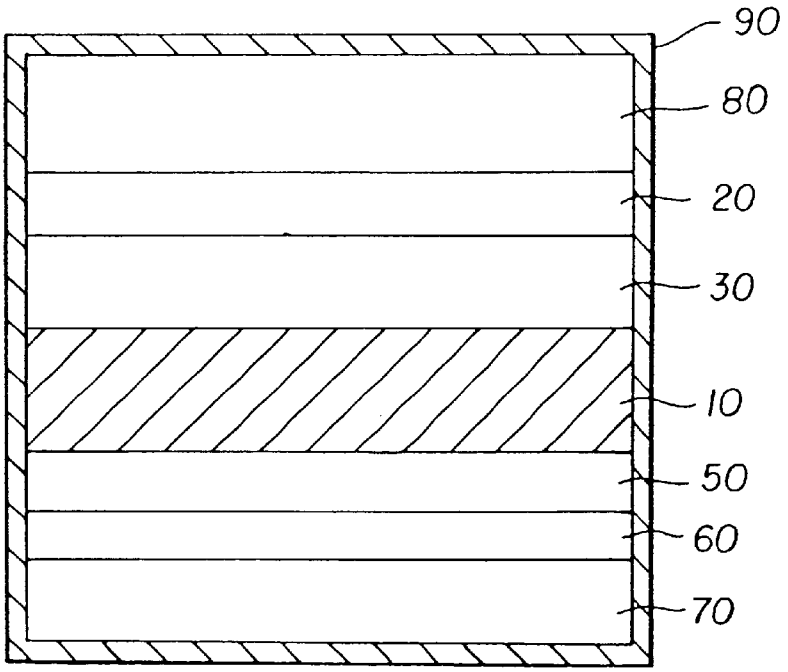
FIG. 2 is a schematic cross-sectional illustration of a radiographic imaging assembly of this invention comprising a radiographic silver halide film of this invention arranged in association with a single fluorescent intensifying screen in a cassette holder.

FIG. 2 shows the radiographic film of FIG. 1 that is arranged in association with fluorescent intensifying screen 80 on the frontside, and both in cassette holder 90.

Exposure and processing of the radiographic silver halide films of this invention can be undertaken in any convenient conventional manner. The exposure and processing techniques of U.S. Pat. No. 5,021,327 and U.S. Pat. No. 5,576,156 (both noted above) are typical for processing radiographic films. Other processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multi-part formulations, and in concentrated form or as more diluted working strength solutions.

Exposing X-radiation is generally directed through a single fluorescent intensifying screen before it passes through the radiographic silver halide film for imaging of soft tissue such as breast tissue.

It is particularly desirable that the radiographic silver halide films of this invention be processed within 90 seconds ("dry-to-dry") and preferably within 60 seconds and at least 20 seconds, for the developing, fixing and any washing (or rinsing) steps. Such processing can be carried out in any suitable processing equipment including but not limited to, a Kodak X-OMAT™ RA480 processor that can utilize Kodak Rapid Access processing chemistry. Other "rapid access processors" are described for example in U.S. Pat. No. 3,545,971 (Barnes et al.) and EP 0 248,390A1 (Akio et al.). Preferably, the black-and-white developing compositions used during processing are free of any photographic film hardeners, such as glutaraldehyde.

Radiographic kits can include a radiographic silver halide film or imaging assembly of this invention, one or more additional fluorescent intensifying screens and/or metal screens, and/or one or more suitable processing compositions (for example black-and-white developing and fixing compositions).

The following examples are presented for illustration and the invention is not to be interpreted as limited thereby.

EXAMPLE 1

Radiographic Film A (Control)

Radiographic Film A was a dual-coated radiographic film with ⅔ of the silver and gelatin coated on one side of the 170 μm blue-tinted poly(ethylene terephthalate) support and the remainder coated on the opposite side of the support. The frontside had a cubic grain emulsion chemically sensitized with sulfur and gold and spectrally sensitized with Dye A–1 noted below. On the backside was an antihalation layer containing solid particle dyes to provide improved sharpness over a green-sensitized high aspect ratio tabular grain emulsion (Emulsion Layer 2). At least 50% of the total grain projected area was accounted for by tabular grains having a thickness of less than 0.3 μm and having an average aspect ratio greater than 8:1. The emulsion was monodisperse in distribution and was spectrally sensitized with 400 mg/Ag mole of anhydro-5,5-dichloro-9-ethyl-3,3'-bis(3-sulfopropyl)oxacarbocyanine hydroxide, followed by potassium iodide (300 mg/Ag mole).

A-1

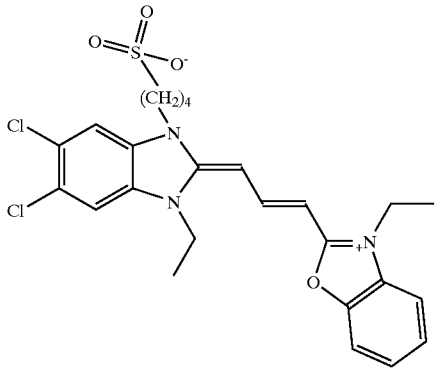

Film A had the following layer arrangement and formulations on the film support:

Overcoat 1
Interlayer
Emulsion Layer 1
Support
Emulsion Layer 2
Halation Control Layer
Overcoat 2

| | Coverage (mg/dm$^2$) |
|---|---|
| Overcoat 1 Formulation | |
| Gelatin vehicle | 4.4 |
| Methyl methacrylate matte beads | 0.35 |
| Carboxymethyl casein | 0.73 |
| Colloidal silica (LUDOX AM) | 1.1 |
| Polyacrylamide | 0.85 |
| Chrome alum | 0.032 |
| Resorcinol | 0.73 |
| Dow Corning Silicone | 0.153 |
| TRITON X-200 surfactant (Union Carbide) | 0.26 |
| LODYNE S-100 surfactant (Ciba Specialty Chem.) | 0.0097 |
| Interlayer Formulation | |
| Gelatin vehicle | 4.4 |
| Emulsion Layer 1 Formulation | |
| Cubic grain emulsion [AgBr 0.85 $\mu$m average ECD] | 40.3 |
| Gelatin vehicle | 29.6 |
| 4-Hydroxy-6-methyl-1,3,3a,7-tetraazaindene | 1 g/Ag mole |
| 1-(3-Acetamidophenyl)-5-mercaptotetrazole | 0.026 |
| Maleic acid hydrazide | 0.0076 |
| Catechol disulfonate | 0.2 |
| Glycerin | 0.22 |
| Potassium bromide | 0.13 |
| Resorcinol | 2.12 |
| Bisvinylsulfonylmethane | 0.4% based on total gelatin in all layers on that side |
| Emulsion Layer 2 Formulation | |
| Tabular grain emulsion [AgBr 1.8 × 0.12 $\mu$m average size] | 10.9 |
| Gelatin vehicle | 16.4 |
| 4-Hydroxy-6-methyl-1,3,3a,7-tetraazaindene | 2.1 g/Ag mole |
| 1-(3-Acetamidophenyl)-5-mercaptotetrazole | 0.013 |
| Maleic acid hydrazide | 0.0032 |
| Catechol disulfonate | 0.2 |
| Glycerin | 0.11 |
| Potassium bromide | 0.06 |
| Resorcinol | 1.0 |
| Bisvinylsulfonylmethane | 2% based on total gelatin in all layers on that side |
| Halation Control Layer | |
| Magenta filter dye M-1 (noted above) | 2.2 |
| Gelatin | 10.8 |
| Overcoat 2 Formulation | |
| Gelatin vehicle | 8.8 |
| Methyl methacrylate matte beads | 0.14 |
| Carboxymethyl casein | 1.25 |
| Colloidal silica (LUDOX AM) | 2.19 |
| Polyacrylamide | 1.71 |
| Chrome alum | 0.066 |
| Resorcinol | 0.15 |
| Dow Corning Silicone | 0.16 |
| TRITON X-200 surfactant | 0.26 |
| LODYNE S-100 surfactant | 0.01 |

Radiographic Film B (Invention)

Film B was like Film A except that Emulsion Layer 1 contained a AgIClBr (0.5:15:84.5 halide mole ratio) cubic grain emulsion (0.71 $\mu$m average ECD) that was chemically sensitized with sulfur and gold and spectrally sensitized with a 340 mg/mole of Ag of Dye A–1 noted above, and Emulsion Layer 2 had the following formulation:

| Emulsion Layer 2 Formulation | Coverage (mg/dm$^2$) |
|---|---|
| Tabular grain emulsion [AgBr 2.0 × 0.10 $\mu$m average size] | 16.1 |
| Gelatin vehicle | 10.8 |
| 4-Hydroxy-6-methyl-1,3,3a,7-tetraazaindene | 2.1 g/Ag mole |
| 1-(3-Acetamidophenyl)-5-mercaptotetrazole | 0.013 |
| Maleic acid hydrazide | 0.0032 |
| Catechol disulfonate | 0.2 |
| Glycerin | 0.11 |
| Potassium bromide | 0.06 |
| Resorcinol | 1.0 |
| Bisvinylsulfonylmethane | 2% based on total gelatin in all layers on that side |

Radiographic Film C (Control)

Film C was like Film A except that Emulsion Layer 1 contained AgIClBr (0.5:25:74.5 halide mole ratio) cubic grain emulsion that was chemically sensitized with sulfur and gold and spectrally sensitized with a 285 mg/mole of Ag of Dye A–1 noted above.

Samples of the films were exposed through a graduated density step tablet to a MacBeth sensitometer for 0.5 second to a 500-watt General Electric DMX projector lamp that was calibrated to 2650°K filtered with a Coming C4010 filter to simulate a green-emitting X-ray screen exposure. The film samples were processed using a processor commercially available under the trademark KODAK RP X-OMAT® film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were processed in each instance for less than 90 seconds. Fixing was carried out using KODAK RP X-OMAT® LO Fixer and Replenisher fixing composition (Eastman Kodak Company).

Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic D vs. Log E curve was plotted for each radiographic film that was imaged and processed. Speed was measured at a density of 1.4 +$D_{min}$. Gamma (contrast) is the slope (derivative) of the noted D vs. Log E curves.

Residual dye stain ("Dye Stain") was measured using spectrophotometric methods and calculated as the difference between density at 505 nm that corresponds to the dye absorption peak, and the density at 700 nm. This measurement corrects for differences in film fog. Measurements were done on film samples that have been processed without exposure and are nominally clear of developed silver except for fog silver. Processing was carried out in an RP X-OMAT Processor Model 480RA using KODAK RA30 Developer and KODAK LO Fixer.

The following TABLE I shows the relative sensitometry of Films A–C. Control Film A had the lowest photographic speed and contrast and the highest dye stain.

TABLE I

| Film | Average Cubic Grain ECD (μm) | Grain Halide(s) (mol %) | Relative Speed | Contrast | Dye Stain |
|---|---|---|---|---|---|
| A (Control) | 0.73 | Br (100) | 408 | 3.5 | 0.06 |
| B (Invention) | 0.73 | IClBr (0.5:15:84.5) | 420 | 4.3 | 0.04 |
| C (Control) | 0.71 | IClBr (0.5:25:74.5) | 416 | 4.0 | 0.03 |

EXAMPLE 2

Further radiographic films were prepared similar to Film B of Example 1 but with various silver halide ratios and grain sizes in Emulsion Layer 1. TABLE II below provides the data for these films and the sensitometric results.

TABLE II

| Film | Average Cubic Grain ECD (μm) | Halide Molar Ratio | Speed | Gamma at Density of 1.0 |
|---|---|---|---|---|
| D (Control) | 0.72 | AgBr | 400 | 4 |
| E (Control) | 0.71 | AgIBr (0.5:99.5) | 404 | 4.2 |
| F (Control) | 0.73 | AgClBr (15:85) | 405 | 4.5 |
| G (Invention) | 0.71 | AgIClBr (0.5:15:84.5) | 409 | 4.6 |
| H (Control) | 0.75 | AgIClBr (0.5:30:69.5) | 402 | 1.9 |

The data in TABLE II show that both speed and contrast increase with increasing chloride up to 30 mole % chloride. However, at that upper level, contrast and speed were severely affected. The reason for this is that it is extremely difficult to maintain good cubicity and grain monodispersity for these grain size emulsions with such high amounts of chloride. Only Film G of the present invention provided maximum speed and contrast.

EXAMPLE 3

Several radiographic films were prepared similar to Film B of Example 1 using cubic silver halide grains with various amounts of iodide content. The chloride content for the cubic grains in each film was 13.2 mol %. The following TABLE III shows the various grain content and sensitometric results.

TABLE III

| Film | Iodide Content (mol %) | Speed | Contrast |
|---|---|---|---|
| I (Control) | 0 | 400 | 3.96 |
| J (Control) | 0.1 | 401 | 4.11 |
| K (Invention) | 0.3 | 402 | 4.13 |
| L (Invention) | 0.5 | 406 | 4.42 |
| M (Invention) | 1 | 405 | 4.38 |
| N (Invention) | 1.5 | 408 | 4.27 |
| O (Control) | 2 | 408 | 3.88 |

The data in TABLE III show the effect of iodide incorporation on speed and contrast. Speed increased with increased iodide levels and contrast also increased until the iodide levels reached about 1.5 mol %. At higher iodide content, contrast began to drop. Films L, M, and N provided desirable speed and contrast.

The invention has been described in detail with particular reference to preferred embodiments thereof, but it will be understood that variations and modifications can be effected within the spirit and scope of the invention.

We claim:

1. A radiographic silver halide film comprising a support having first and second major surfaces and that is capable of transmitting X-radiation, said radiographic silver halide film having disposed on said first major support surface, one or more hydrophilic colloid layers including at least one cubic silver halide grain emulsion layer, and on said second major support surface, one or more hydrophilic colloid layers including at least one silver halide emulsion layer, wherein said silver halide cubic grain emulsion layer comprises cubic silver halide grains comprising from about 1 to about 20 mol % chloride and from about 0.25 to about 1.5 mol % iodide, both based on total silver in the emulsion layer, which cubic grains have an average ECD of from about 0.65 to about 0.8 μm.

2. The film of claim 1 wherein said cubic silver halide grains are composed of from about 10 to about 20 mol % chloride, based on total silver in the emulsion layer.

3. The film of claim 1 wherein said cubic grains are composed of from about 0.5 to about 1.5 mol % iodide, based on total silver in the emulsion layer.

4. The film of claim 1 wherein said cubic grains have an ECD of from about 0.7 to about 0.75 μm.

5. The film of claim 1 wherein said silver halide emulsion layer on said second major support surface comprises predominantly tabular silver halide grains.

6. The film of claim 1 further comprising an antihalation layer disposed on said second major support surface.

7. The film of claim 1 further comprising a protective overcoat disposed over said hydrophilic layers on each side of said support.

8. The film of claim 1 wherein the amount polymer vehicle on each side of its support in a total amount of from about 35 to about 45 mg/dm$^2$ and a level of silver on each side of from about 10 to about 55 mg/dm$^2$.

9. A radiographic silver halide film comprising a support having first and second major surfaces and that is capable of transmitting X-radiation, said radiographic silver halide film having disposed on said first major support surface, one or more hydrophilic colloid layers including at least one cubic silver halide grain emulsion layer, and on said second major support surface, one or more hydrophilic colloid layers including at least one silver halide emulsion layer comprising predominantly tabular silver halide grains, and an antihalation layer, wherein said silver halide cubic grain emulsion layer comprises predominantly cubic silver halide grains comprising from about 10 to about 20 mol % chloride and from about 0.5 to about 1.5 mol % iodide, both based on total silver in the emulsion layer, which cubic grains have an average ECD of from about 0.7 to about 0.75 $\mu$m, and a protective overcoat disposed over all silver halide emulsion layers on both sides of said support.

10. A radiographic imaging assembly comprising the radiographic silver halide film of claim 1 that is arranged in association with a fluorescent intensifying screen.

11. The radiographic imaging assembly of claim 10 comprising a single fluorescent intensifying screen.

12. A method of providing a black-and-white image comprising exposing the radiographic silver halide film of claim 1, and processing it, sequentially, with a black-and-white developing composition and a fixing composition, the processing being carried out within 90 seconds, dry-to-dry.

13. The method of claim 12 wherein said black-and-white developing composition is free of any photographic film hardeners.

14. The method of claim 12 being carried out for 60 seconds or less.

* * * * *